US006350158B1

(12) United States Patent
Arnett et al.

(10) Patent No.: US 6,350,158 B1
(45) Date of Patent: Feb. 26, 2002

(54) LOW CROSSTALK COMMUNICATION CONNECTOR

(75) Inventors: Jaime Ray Arnett, Fishers; Robert Ray Goodrich, Indianapolis, both of IN (US); Amid Ihsan Hashim, Randolph, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/664,814

(22) Filed: Sep. 19, 2000

(51) Int. Cl.[7] ..... H01R 24/00
(52) U.S. Cl. ..... 439/676; 439/941; 439/344
(58) Field of Search ..... 439/676, 557, 439/344, 941

(56) References Cited

U.S. PATENT DOCUMENTS

| | | | | |
|---|---|---|---|---|
| 5,186,647 A | | 2/1993 | Denkmann | |
| 5,299,956 A | | 4/1994 | Brownell | |
| 5,580,270 A | | 12/1996 | Pantland | |
| 5,885,111 A | * | 3/1999 | Yu | 439/676 |
| 5,997,358 A | | 12/1999 | Adriaenssens | |
| 6,116,964 A | | 9/2000 | Goodrich | |
| 6,139,371 A | | 10/2000 | Troutman | |
| 6,155,881 A | | 12/2000 | Arnett | |
| 6,165,023 A | | 12/2000 | Troutman | |
| 6,176,742 B1 | | 1/2001 | Arnett | |
| 6,186,834 B1 | * | 2/2001 | Arnett et al. | 439/676 |
| 6,196,880 B1 | * | 3/2001 | Goodrich et al. | 439/676 |

* cited by examiner

*Primary Examiner*—Gary Paumen
*Assistant Examiner*—Ross Gushi
(74) *Attorney, Agent, or Firm*—Law Office of Leo Zucker

(57) ABSTRACT

A communication connector assembly that incorporates crosstalk compensation. A number of compensation coupling contacts, e.g., conductive pads, stiff wires or plates, are mounted on a front edge region of a wire board that supports a number of terminal contact wires. Compensation elements associated with the wire board are connected to the contacts and are selected to produce, e.g., capacitive crosstalk compensation coupling. The terminal contact wires have connecting portions for contacting corresponding terminals of a mating connector along a line of contact. Free ends of the contact wires, ahead of the line of contact, are formed to deflect toward the wire board and to connect with the compensation coupling contacts on the board when engaged by the mating connector. The compensation coupling is therefore effective at the line of contact with the mating connector. In the disclosed embodiments, the assembly is incorporated in a modular jack connector.

19 Claims, 6 Drawing Sheets

LOW CROSSTALK COMMUNICATION CONNECTOR

BACKGROUND OF THE INVENTION

1. Field of the Invention

This invention relates to communication connectors constructed to compensate for crosstalk among signal paths. carried through the connectors.

2. Discussion of the Known Art

There is a need for a durable, high-frequency communication connector that compensates for (i.e., cancels or reduces) crosstalk among different signal paths through the connector. As defined herein, crosstalk occurs when signals conducted over a first path, e.g., a pair of terminal contact wires associated with a communication connector, are partly transferred by inductive or capacitive coupling into a second path, e.g., another pair of terminal contact wires in the same connector. The transferred signals produce "crosstalk" in the second path, and such crosstalk degrades existing signals routed over the second path.

For example, a typical industry type RJ-45 communication connector includes four pairs of contact wires defining four different signal paths. In conventional RJ-45 plug and jack connectors, all four pairs of wires extend closely parallel to one another over the length of the connector body. Thus, signal crosstalk may be induced between and among different pairs of connector wires, particularly in a mated plug and jack combination. The amplitude of the crosstalk generally increases as the signal frequencies or data rates increase.

Applicable industry standards for rating the degree to which communication connectors exhibit crosstalk, do so in terms of near-end crosstalk or "NEXT". These ratings are typically specified for mated plug and jack combinations, wherein input terminals on the plug connector are used as a reference plane. Communication links using unshielded twisted pairs (UTP) of copper wire are now expected to support data rates up to not only 100 MHz or industry standard "Category 5" performance, but to meet or exceed "Category 6" performance levels which call for at least 46 dB crosstalk loss at 250 MHz.

U.S. Pat. No. 5,186,647 (Feb. 16, 1993) discloses an electrical connector with crosstalk compensation for conducting high frequency signals. The connector has a pair of metallic lead frames with connector terminals formed at opposite ends of the lead frames. When the lead frames are mounted on a dielectric spring block, three conductors of one lead frame have cross-over sections that align with corresponding cross-over sections of three conductors in the other lead frame. All relevant portions of the '647 patent are incorporated by reference. U.S. Pat. No. 5,580,270 (Dec. 3, 1996) also discloses an electrical plug connector having crossed pairs of contact strips.

Crosstalk compensation circuitry may also be provided on or within layers of a printed wire board, to which spring terminal contact wires of a communication jack are connected within the jack housing. See U.S. Pat. No. 5,997,358 (Dec. 7, 1999) all relevant portions of which are incorporated by reference. See also U.S. Pat. No. 5,299,956 (Apr. 5, 1994).

U.S. Pat. No. 6,116,964 (Sep. 12, 2000), also incorporated by reference, discloses a communication connector assembly having co-planar terminal contact wires that are spaced a certain distance above a wire board. Base portions of the wires are received in plated openings in the board, and certain pairs of the wires have opposed cross-over sections formed near a line of contact between the wires and a mating connector. A coupling region along the wires beyond the cross-over sections further compensates for crosstalk introduced by the mating connector.

U.S. Pat. No. 6,139,371 issued Oct. 31, 2001, and U.S. Pat. No. 6,165,023 issued Dec. 26, 2000, both of which are assigned to the assignee of the present invention and application, relate to communication connectors in which capacitive crosstalk compensation coupling is provided between leading portions of pairs of terminal contact wires in the connectors. U.S. patent application No. 09/583,503 filed May 31, 2000, and assigned to the assignee of the present invention and application, discloses a communication connector in which parallel plate capacitors are formed at free ends of certain pairs of terminal contact wires for producing crosstalk compensation in the connector.

U.S. Pat. No. 6,176,742 issued Jan. 23, 2001, and assigned to the assignee of the present invention and application, relates to a capacitor compensation assembly for a communication connector wherein terminals of the assembly make electrical contact with certain terminal contact wires of the connector, when the contact wires of the connector are engaged by a mating connector. See also commonly owned U.S. Pat. No. 6,155,881 issued Dec. 5, 2000.

A communication connector which, when connected with a mating connector provides such crosstalk compensation that the connectors meet or exceed Category 6 performance levels, is very desirable in today's telecommunications environment.

SUMMARY OF THE INVENTION

According to the invention, a communication connector assembly includes a wire board having a front edge region, and a number of compensation coupling contacts at the edge region which contacts are coupled to compensation elements selected to produce a desired crosstalk compensation coupling. A number of terminal contact wires extend over the wire board for connection with corresponding terminals of a mating connector along a line of contact. The contact wires have connecting portions for electrically contacting the corresponding terminals of the mating connector wherein the connecting portions have free ends, and base portions arranged to support the contact wires on the board.

The free ends of the terminal contact wires are located ahead of the line of contact, and are formed to deflect toward the wire board and to connect with corresponding ones of the compensation coupling contacts when the mating connector engages the connector assembly. Accordingly, the crosstalk compensation coupling becomes operative at the line of contact between the terminal contact wires and the mating connector, where such coupling can be most effective.

For a better understanding of the invention, reference is made to the following description taken in conjunction with the accompanying drawing and the appended claims.

DETAILED DESCRIPTION OF THE INVENTION

Figure 1:
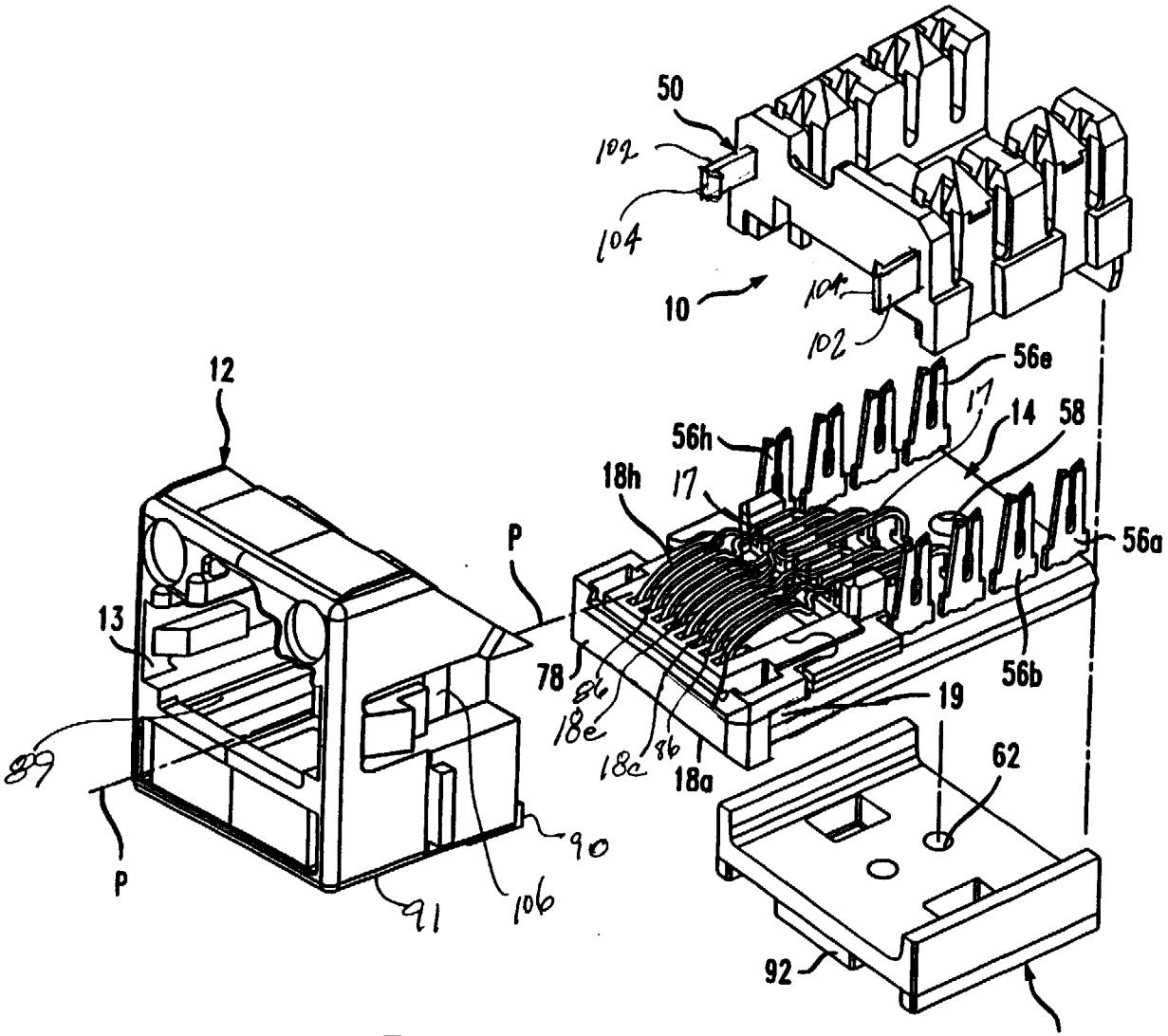
FIG. 1 is an assembly view of a communication connector according to the invention.

FIG. 1 is an assembly view of a communication connector 10 according to the invention. The connector 10 includes a jack housing 12 having a front face in which a plug opening 13 is formed. The plug opening 13 has an axis P along the direction of which a mating plug connector 11 (see FIG. 5) is insertable into the jack housing.

The communication connector 10 also includes a generally rectangular printed wire board 14. For example, the board 14 may comprise a single or a multi-layer dielectric substrate. A number of elongated terminal contact wires 18*a*–18*h* extend in a generally horizontal direction with respect to a top surface of the Wire board 14, and substantially parallel to one another. Connecting portions 17 of the contact wires are spaced a certain distance (e.g., 0.090 inches) from the top surface of the wire board 14.

Figures 2, 3:
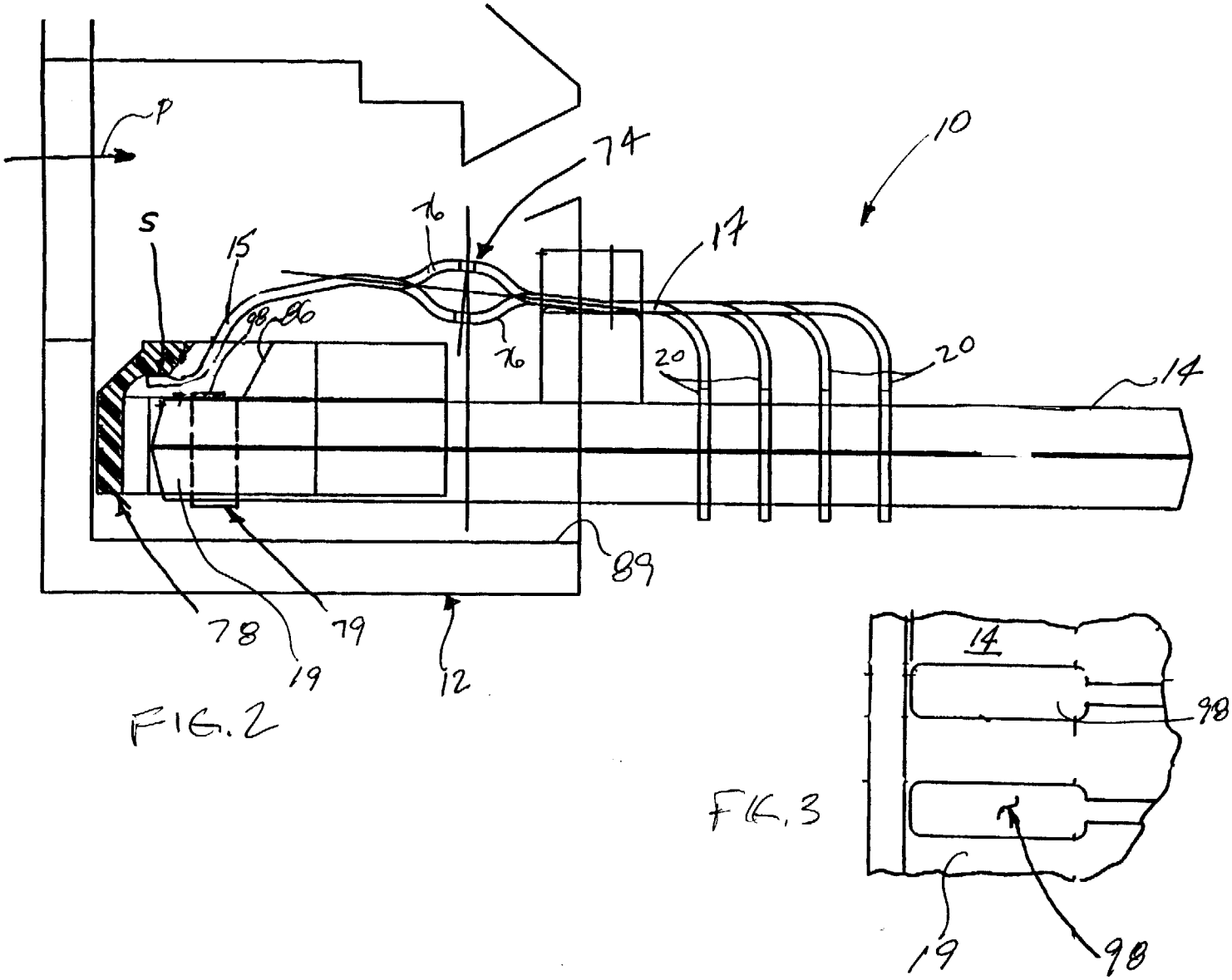
FIG. 2 is an enlarged, side view of a wire board in the connector of FIG. 1, and contact wires on the board at a first position out of engagement with compensation coupling contacts at a front edge region of the board.
FIG. 3 is an enlarged plan view of two compensation coupling contacts in the form of pads at the front edge region of the wire board in FIG. 2.

As seen in FIG. 2, free ends 15 of the connecting portions 17 curve downward toward a front edge region 19 of the wire board 14. The free ends 15 are formed to deflect resiliently in the direction of the front edge region 19 of the board when blade contacts 21 of the plug connector 11 wipe over the connecting portions 17 of the contact wires 18*a*–18*h* in a direction parallel to the top surface of the board (i.e., along the axis P). See FIG. 3. The terminal contact wires 18*a*–18*h* may be formed of a copper alloy such as spring-tempered phosphor bronze, beryllium copper, or the like. A typical cross-section of the contact wires is 0.015 inch wide by 0.010 inch thick.

Terminal contact wires 18*a*–18*h* have associated base portions 20 opposite the free ends 15. Each base portion 20 is formed to connect a contact wire to one or more conductors (not shown) on or within the wire board 14. For example, the base portions 20 may be soldered or press-fit in plated terminal openings formed in the board, to connect with corresponding conductive paths on or within the board. As shown in the drawing, the base portions 20 project in a generally normal direction with respect to the top surface of the wire board 14.

In the disclosed embodiment, the base portions 20 are shown as entering the wire board 14 with a preferred, "duo-diagonal" footprint pattern. Alternatively, the base portions may enter the wire board with other footprints, e.g., a "saw tooth" pattern, as long as there is sufficient spacing between the plated openings that receive the base portions to avoid electrical arcing, per industry requirements.

The wire board 14 may incorporate electrical circuit components or devices arranged, for example, on or within a rear portion of the board, to compensate for connector-induced crosstalk. Such devices include but are not limited to wire. traces printed on or within layers of.the board 14, as disclosed in the mentioned '358 U.S. Patent.

An electrically insulative, dielectric terminal housing 50 (FIG. 1) covers a rear portion of the wire board 14. Outside insulated wire leads may be connected to insulation displacing connector (IDC) terminals 56*a* to 56*h* on the board, which terminals are only partly surrounded by housing terminal guards. The housing 50 is formed of a plastics or other insulative material that meets all applicable standards with respect to electrical insulation and flammability. Such materials include but are not limited to polycarbonate, ABS, and blends thereof. The housing 50 has, for example, at least one fastening or mounting post (not shown) that projects from a bottom surface of the housing to pass through one or more openings 58 formed along the long axis of the board 14.

Terminals 56*a*–56*h* are mounted along both sides of the rear portion of the wire board 14, as seen in FIG. 1. Each of the terminals 56*a*–56*h* has a mounting.portion that is soldered or press fit in a corresponding terminal mounting hole in the board, to connect via a conductive path (not shown) with a corresponding one of the terminal contact wires 18*a*–18*h*. When the terminal housing 50 is aligned above the IDC terminals 56*a*–56*h*, and then lowered to receive the terminals in corresponding slots in the terminal guards, a fastening post of the housing 50 aligns with and passes through an opening 58 in the board 14.

A cover 60 is formed of the same or a similar material as the terminal housing 50. The cover 60 is arranged to protect the rear portion of the wire board 14 from below. Cover 60 has at least one opening 62 which aligns with a tip of a fastening post of the housing 50, below the opening 58 in the wire board. The board is thus captured and secured between the terminal housing 50 and the cover 60, and the tip of the fastening post is joined to the body of the cover 60 by, e.g., ultrasonic welding, so that the rear portion of the wire board is protectively enclosed. See U.S. Pat. No. 5,924,896 (Jul. 20, 1999), all relevant portions of which are incorporated by reference.

Figure 4:
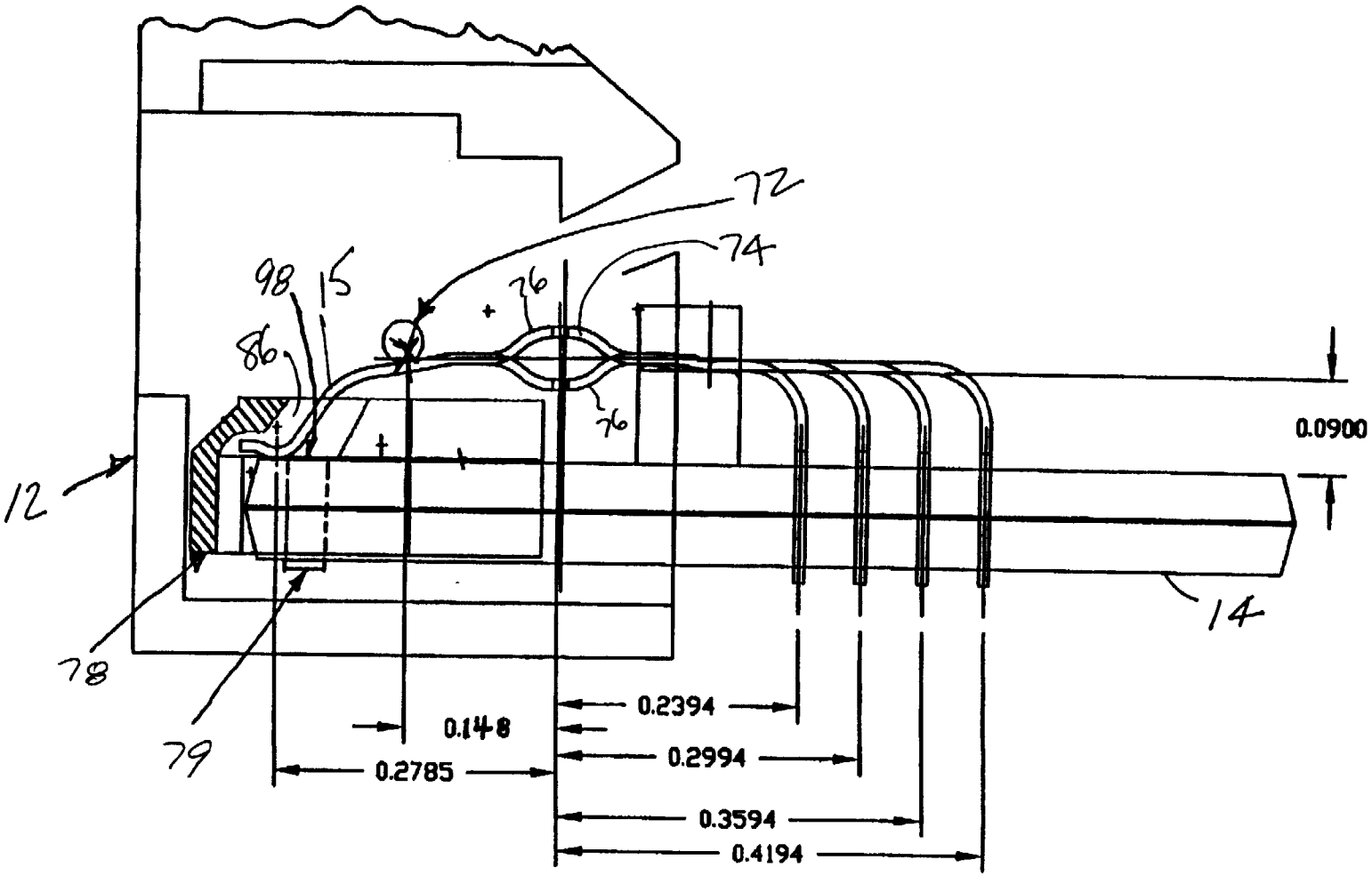
FIG. 4 is a side view as in FIG. 2, showing the contact wires at a second position in engagement with the compensation coupling contacts at the front of the wire board.
Figure 5:
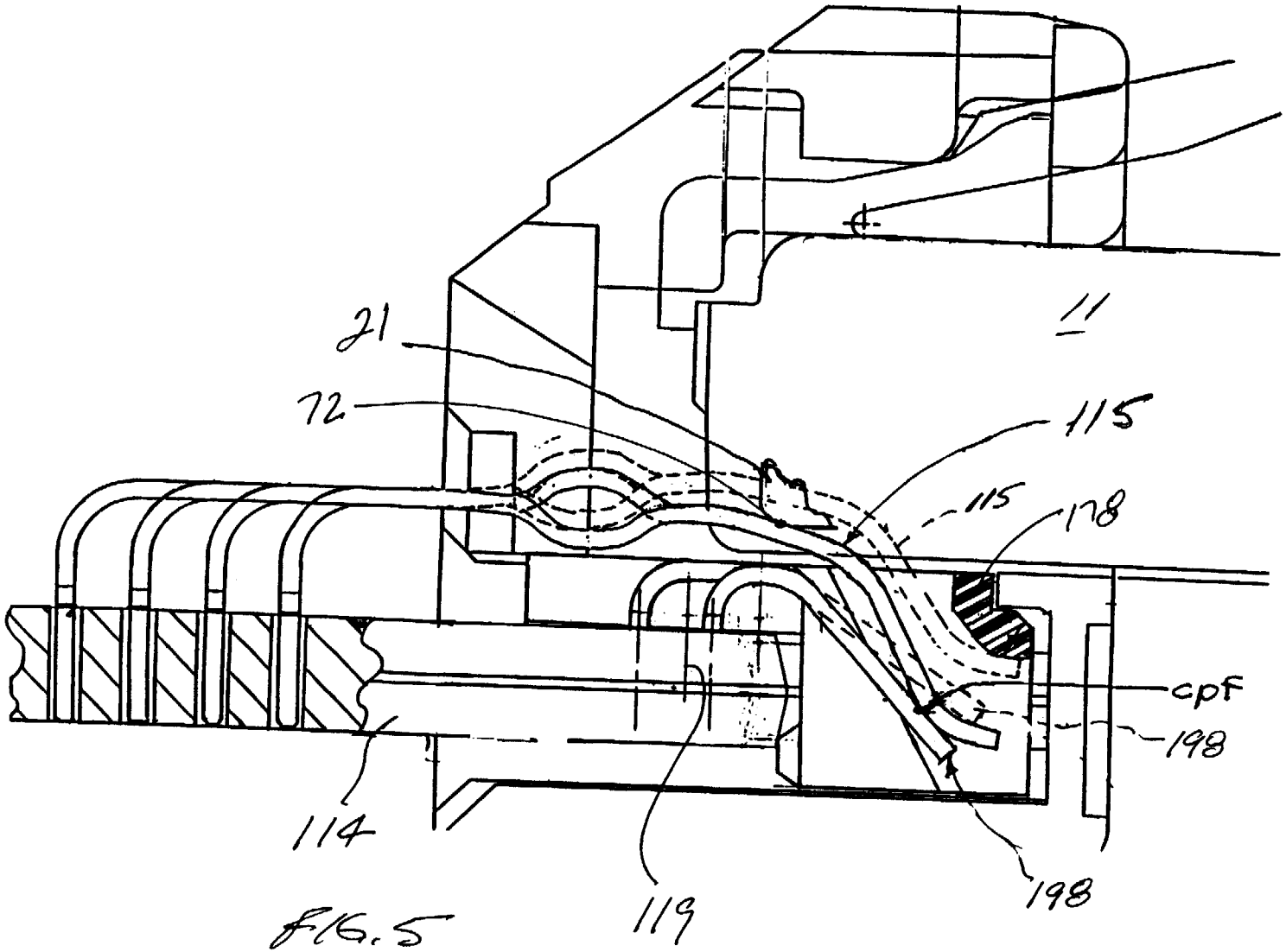
FIG. 5 is a side view of a second embodiment of a communication connector according to the invention.

The connecting portions 17 of the terminal contact wires, between the base portions 20 and the free ends 15 of the wires, are formed to make electrical contact with corresponding blade contacts 21 of the plug connector 11 (see, e.g., FIG. 5). A line of contact 72 (see FIGS. 4 & 5) is defined transversely of the contact wires, along which electrical connections are established between the connector 10 and the blade contacts 21 of the plug connector 11. As mentioned, when the plug connector 11 is inserted in the opening 13 of the jack housing 12, the free ends 15 of contact wires 18*a*–18*h* are deflected in unison toward the front edge region 19 of the wire board 14.

Certain pairs of the terminal contact wires have cross-over sections 74 at which one contact wire of a pair is stepped toward and crosses over the other contact wire of the pair, with a generally "S"-shaped side-wise step 76. As seen in FIGS. 2 and 4, the terminal contact wires curve arcuately above and below their common plane at each cross-over section 74. Opposing faces of the steps 76 in the contact wires are typically spaced by about 0.040 inches (i.e., enough to prevent shorting when the terminal wires are engaged by the mating connector 11).

The cross-over sections 74 are relatively close to the line of contact 72, and serve to allow inductive crosstalk compensation coupling to be induced among parallel portions of the terminal contact wires in a region between the cross-over sections 74 and the base portions 20 of the contact wires.

A terminal wire guide block 78 is mounted on the front edge region 19 of the wire board 14, as shown in FIGS. 1, 2 and 4. The guide block 78 has equi-spaced vertical guide ways 86. The free ends 15 of the terminal contact wires extend within corresponding ones of the guide ways, and are guided individually for vertical movement when deflected by the blade contacts 21 of the plug connector 11, as in FIG. 4. Each guide way 86 is, e.g., 0.020 inch wide, and 0.020 inch thick walls separate adjacent ones of the guide ways. The guide block 78 may also have, e.g., ribbed mounting posts 79 that project downward to register with corresponding mounting holes in the wire board 14 to establish a press-fit.

When in the undeflected position of FIG. 2, the free ends 15 of the terminal contact wires abut an upper inside surface of each guideway 86. A determined pre-load force is thus established, to be applied by the blade contacts 21 of the plug connector 11 as the former wipe against and urge the free ends 15 of the contact wires downward to the position of FIG. 4.

As they deflect downward, the free ends 15 of the contact wires themselves establish a wiping contact against corresponding compensation coupling contacts in the form of conductive contact pads 98. See FIGS. 2 & 3. The pads 98 are arrayed in a row parallel to and near the front edge of the wire board, and are spaced apart from one another by a distance corresponding to a spacing between the free ends 15 of the terminal contact wires. The guideways 86 of the block 78 serve to keep the free ends 15 aligned and centered with corresponding ones of the contact pads 98 on the wire board.

The contact pads 98 are connected by conductive paths to, e.g., capacitive crosstalk compensation elements on or within the wire board 14. Accordingly, when the terminal contact wires are engaged by a mating connector, certain pairs of contact wires will be capacitively coupled to one another by compensation elements connected to the corresponding contact pads 98. Note that the free ends 15 are ahead of and near the line of contact 72 with the mating connector. Crosstalk compensation coupling is thus introduced onto non-current carrying portions of the contact wires, and operates at the connector interface (i.e., the line of contact 72) where such coupling can be most effective.

FIG. 3 is an enlarged view of two adjacent contact pads 98. Each pad is typically, e.g., 0.018 inches wide, and side edges of the pads are typically spaced apart from one another by, e.g., 0.022 inches to meet a specified 1000 volt breakdown requirement. Corners of the contact pads 98 are preferably rounded with a radius of, e.g., 0.004 inches.

Crosstalk compensation elements or devices that are coupled to the contact pads 98 are provided in a region 100 on or within the wire board 14, in the vicinity of the pads 98 at the front edge region 19 of the wire board 14. See FIG. 9. Compensation elements within the region 100 preferably are not part of any other capacitive or inductive compensation circuitry that may be incorporated at other portions (e.g., toward the rear) of the board 14. Placing the compensation elements close to the associated contact pads 98 enhances the effect of such elements at the connector interface.

The wire board 14 including the front edge region 19 with the array of contact pads 98, may be supported within space available in existing jack frames such as, e.g., jack frames provided with the type "MGS 300" series of modular connectors available from Avaya Inc.

The wire board 14 with the guide block 78 mounted at front edge region 19, is inserted in a passage 89 that opens in a rear wall of the jack housing 12. See FIGS. 1 & 2. Side edges of the board 14 are guided for entry into the housing 12 by, e.g., flanges that project from inside walls of the jack housing 12. The jack housing has a slotted catch bar 90 (FIG. 1) protruding rearwardly from a bottom wall 91 of the housing. The bar 90 is arranged to capture a lip 92 that projects downward beneath the wire board cover 60. When the wire board 14 is secured in the jack housing 12, the top surface of the board is parallel to the plug opening axis P along the direction of which the plug connector 11 may engage and disengage the free ends 15 of the contact wires 18*a*–18*h*.

Further, in the present embodiment, two side catches 102 project forward from both sides of the terminal housing 50, and the catches 102 have hooked ends 104 that snap into and lock within recesses 106 formed in both side walls of the jack housing 12. Thus, all adjoining parts of the connector 10 are positively joined to one another to reduce movement between them, and to maintain rated connector performance by reducing variation in relative positions of the connector parts when finally assembled.

Figure 6:
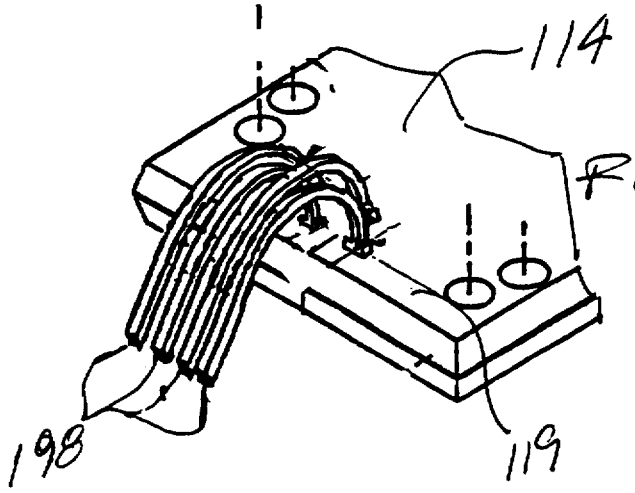
FIG. 6 is a perspective view of a front edge region of a wire board in the embodiment of FIG. 5, showing compensation coupling contacts in the form of stiff wires mounted on the board.

FIGS. 5 and 6 show a front edge region 119 of a wire board 114 in a second embodiment of a connector assembly according to the invention. In the second embodiment, free ends 115 of the terminal contact wires project forwardly beyond the front edge region 119 of the board 114. A number of arcuate, stiff wire contacts 198 are mounted at the front edge region 119, and are aligned beneath corresponding free ends 115 of the contact wires.

FIG. 5 shows, in dotted lines, the position of the free ends 115 of the terminal contact wires in a pre-loaded state, resting against upper ledges in the guide ways of a guide block 178 mounted on the wire board 114. FIG. 5 also shows an initial position of the contacts 198 in dotted lines. When the mating plug connector 11 is received in the jack frame, the free ends 115 of the terminal contact wires deflect resiliently downward. The wire contacts 198 mounted on the board are then engaged by the free ends of those terminal contact wires aligned above them, as shown in solid lines in FIG. 5. Like the first embodiment, this arrangement introduces crosstalk compensation coupling via associated compensation elements disposed near the wire contacts 198, on or within the wire board 114.

Figure 7:
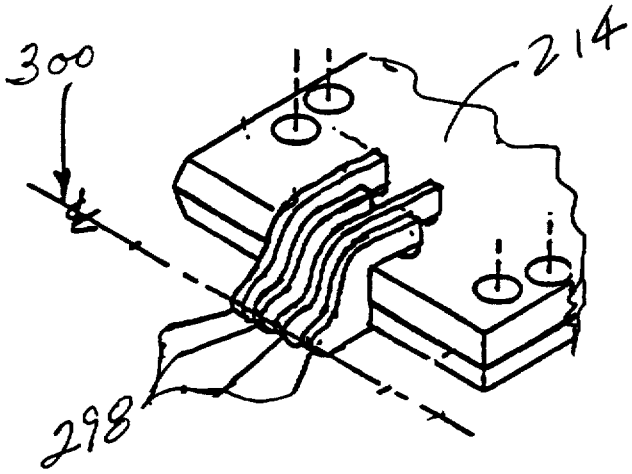
FIG. 7 is a perspective view of a front edge region of a wire board in a third embodiment of communication connector according to the invention, showing compensation coupling contacts in the form of metal plates mounted on the wire board.
Figure 8:
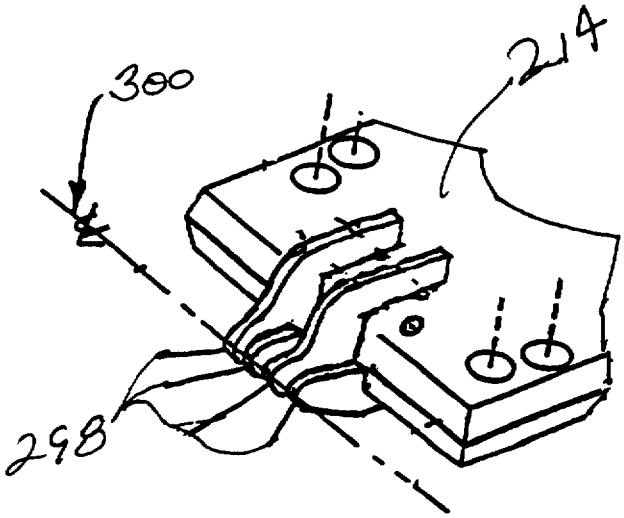
FIG. 8 shows an alternate arrangement of the metal plate contacts on the wire board in FIG. 7.

FIGS. 7 and 8 show a third embodiment wherein compensation coupling contacts 298 are in the form of non-compliant conductive members, e.g., stamped metal plates. The metal plates may have, for example, compliant "needle-eye" mounting bases (not shown) dimensioned and formed to be press-fit into corresponding plated terminal openings in an associated wire board 214. As the free ends of the terminal contact wires deflect downward, they make contact with corresponding ones of the metal plates along a contact line 300. FIG. 8 shows an arrangement wherein the mounting bases of adjacent metal plates 298 enter the wire board 214 from opposite sides of the board, thus reducing potential offending crosstalk that might otherwise be induces among the plates 298.

Figure 9:
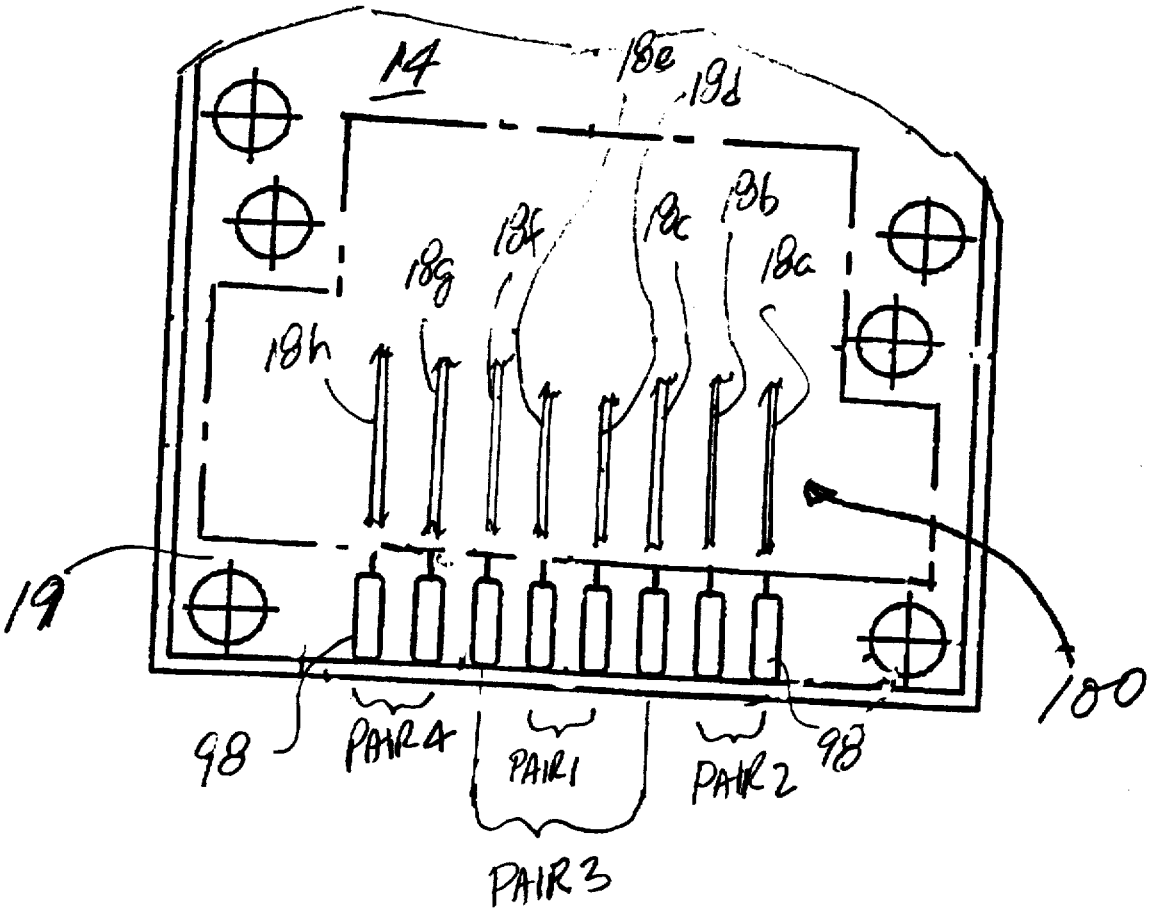
FIG. 9 is a plan view of the front edge region of the wire board in the embodiment of FIGS. 1–4.
Figure 1:
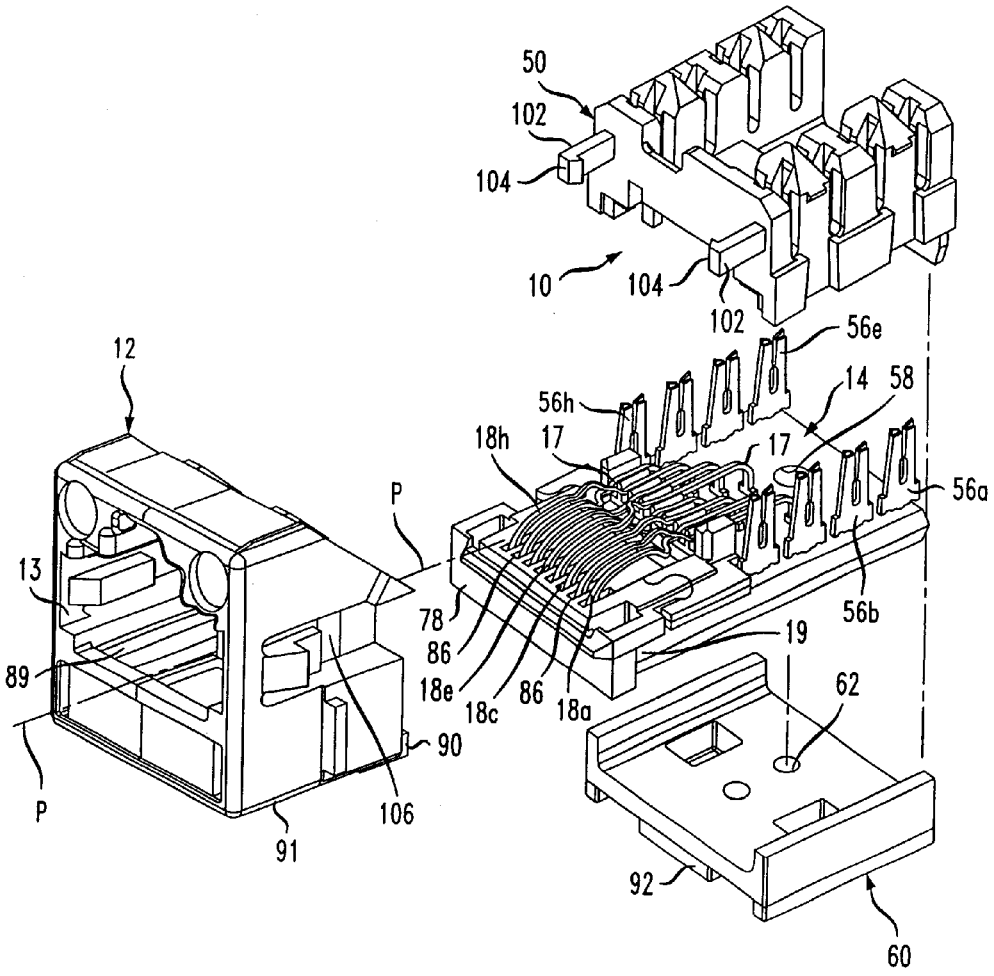
Figure 2:
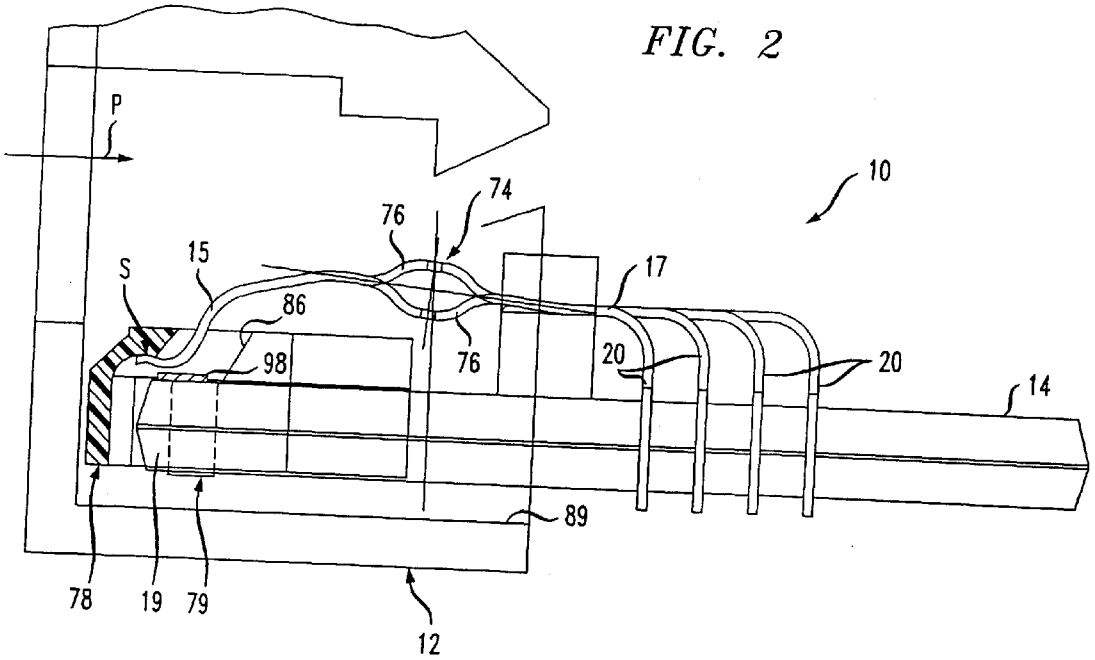
Figure 3:
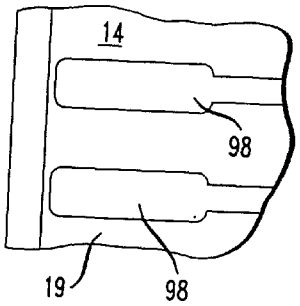
Figure 4:
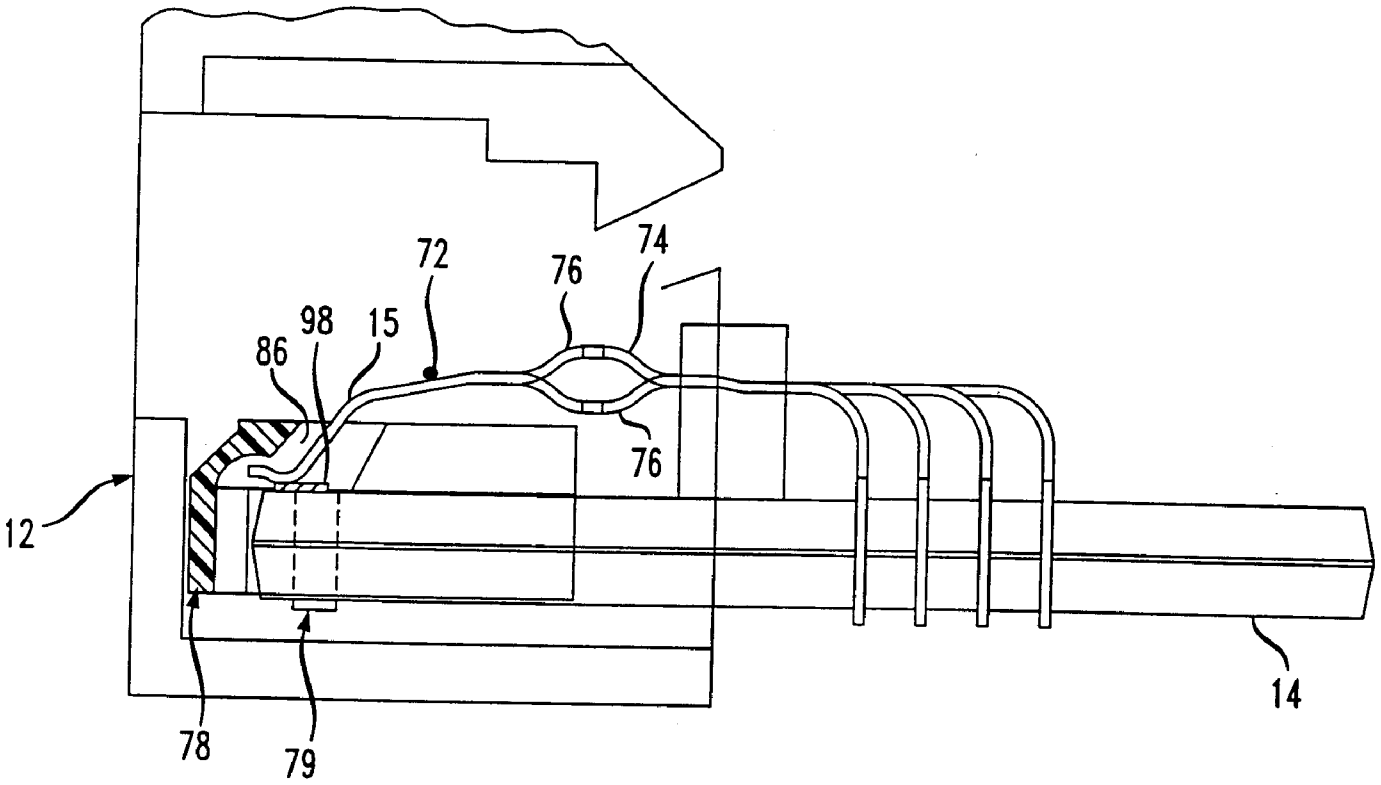
Figure 5:
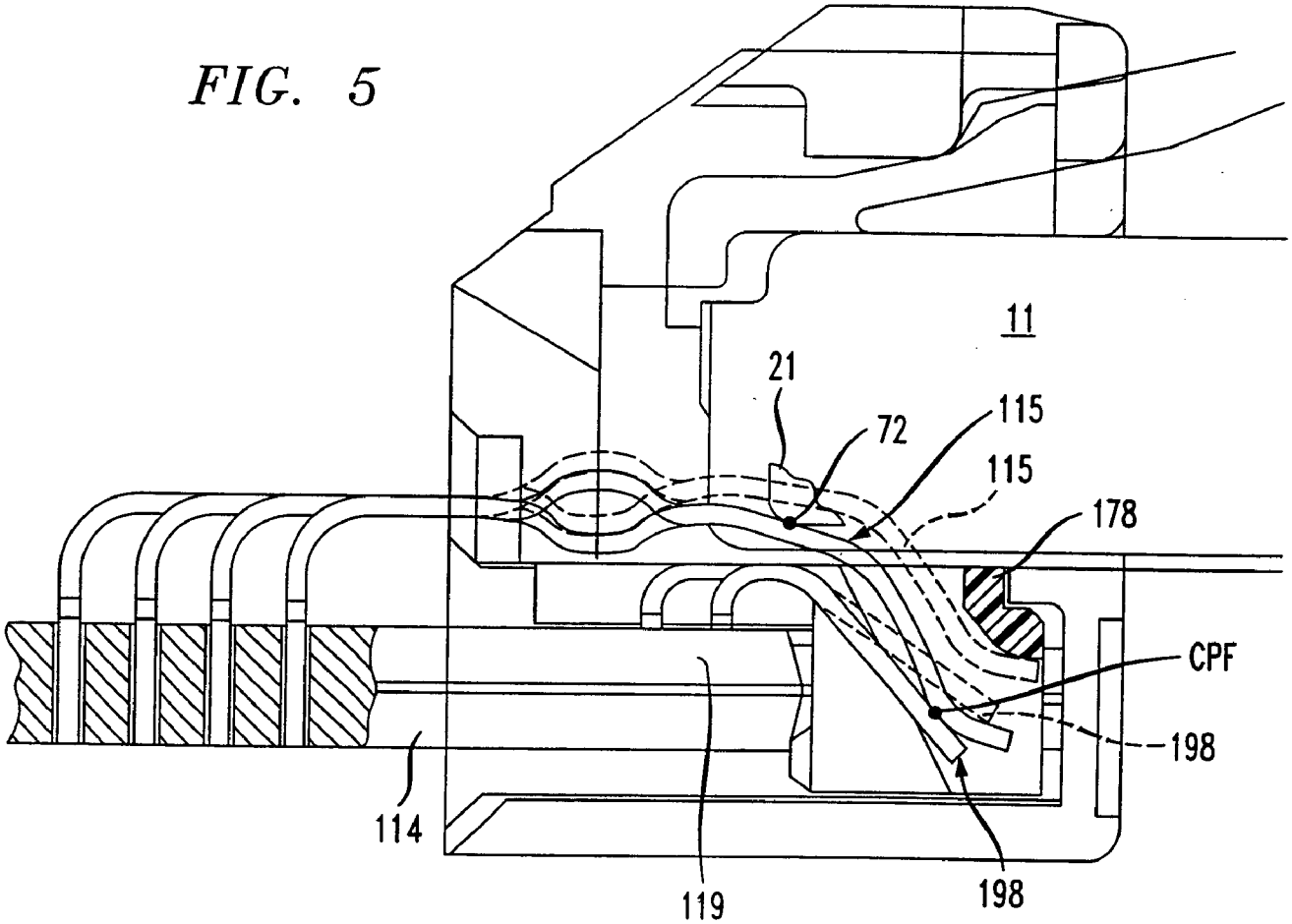
Figure 6:
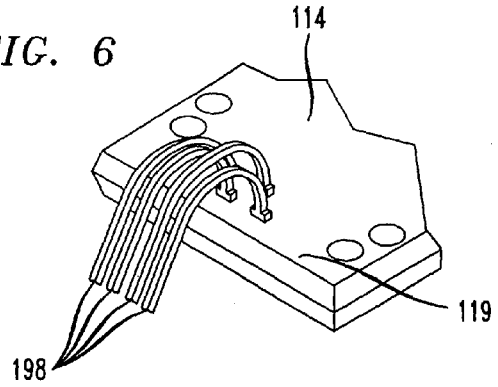
Figure 7:
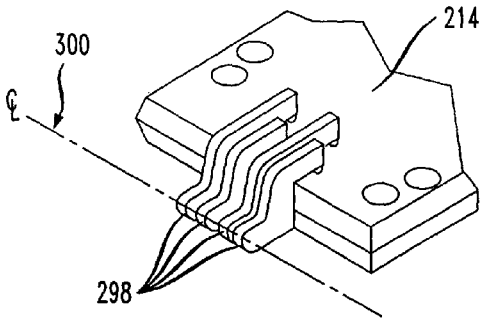
Figure 8:
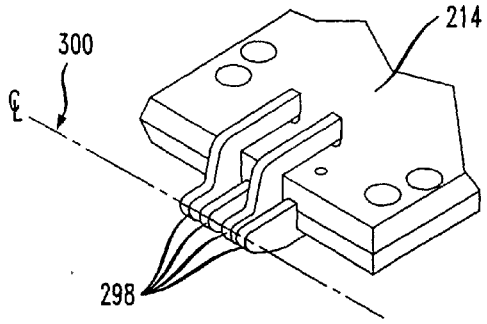
Figure 9:
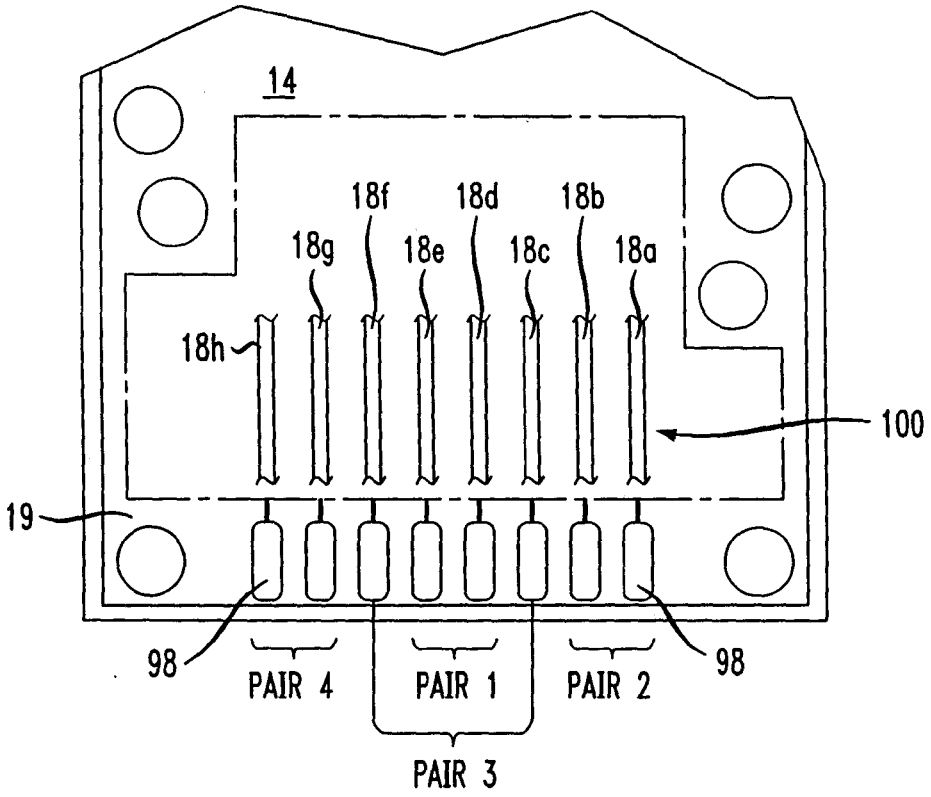

FIG. 9 is a view of the front edge region 19 of the wire board 14 in the embodiment of FIGS. 1–4, showing eight contact pads 98. Each of the pads is disposed on the board 14 in operative relation beneath a free end of an associated terminal contact wire (not shown). Capacitive compensation coupling was introduced between pairs of the pads by way of wire traces or elements embedded within the region 100 on the board 14, as detailed later below. The rightmost pad 98 in FIG. 9 is associated with contact wire 18*a* in FIG. 1, and the leftmost pad in the figure is associated with contact wire 18*h*. Four pairs of the eight contact wires define four different signal paths in the connector 10, and the signal-carrying pairs of contact wires are identified by number as follows with reference to FIG. 9.

| PAIR NO. | CONTACT WIRES |
|---|---|
| 1 | 18d and 18e |
| 2 | 18a and 18b |
| 3 | 18c and 18f |
| 4 | 18g and 18h |

Values of capacitive compensation coupling introduced via the pads 98 associated with the contact wires, were as follows.

| Pads 98 associated with contact wires | Capacitance (picofarads) between pads |
|---|---|
| 18a and 18c | 0.04 |
| 18a and 18d | 0.04 |
| 18b and 18e | 0.09 |
| 18b and 18f | 0.42 |
| 18c and 18e | 1.25 |
| 18d and 18f | 1.25 |

NEXT measurements were performed with the above values of capacitive coupling introduced via the pads 98 between the free ends of the contact wires. Some crosstalk compensation was also provided in a region of the wire board 14 outside the region 100. Category 6 performance was met or exceeded among all four signal-carrying pairs of the contact wires in the connector 10.

While the foregoing description represents preferred embodiments of the invention, it will be obvious to those skilled in the art that various changes and modifications may be made, without departing from the spirit and scope of the invention pointed out by the following claims.

We claim:

1. A communication connector assembly, comprising:

a wire board having a front edge region, a number of compensation coupling contacts disposed at the front edge region, and one or more compensation elements associated with the coupling contacts, said elements being selected to produce a desired crosstalk compensation coupling;

a number of elongated terminal contact wires extending above the wire board for making electrical connections with corresponding terminals of a mating connector along a line of contact, wherein the terminal contact wires include:

connecting portions for making electrical contact with the corresponding terminals of the mating connector, the connecting portions having free ends;

base portions opposite the free ends of the connecting portions, wherein the base portions are arranged to support the contact wires on the board and to connect the contact wires to conductive paths on or within the board; and the free ends of the contact wires are located ahead of said line of contact, and are formed to be deflected toward the wire board and to connect with corresponding ones of the compensation coupling contacts when the connector assembly is engaged by the mating connector, so that said crosstalk compensation coupling is operative at said line of contact.

2. A connector assembly according to claim 1, wherein the compensation coupling contacts are in the form of conductive pads.

3. A connector assembly according to claim 1, wherein the compensation coupling contacts are in the form of stiff wires mounted on the wire board.

4. A connector assembly according to claim 1, wherein the compensation elements associated with the coupling contacts are disposed in a region of the wire board in the vicinity of the coupling contacts.

5. A connector assembly according to claim 1, wherein the compensation coupling contacts are arrayed in a row along the front edge region of the wire board.

6. A connector assembly according to claim 5, wherein the compensation coupling contacts are spaced apart from one another by a distance corresponding to a spacing between the free ends of the terminal contact wires.

7. A connector assembly according to claim 1, wherein the compensation coupling contacts are in the form of metal plates having bases mounted on the wire board.

8. A connector assembly according to claim 7, wherein the bases of adjacent ones of the metal plates enter the wire board from opposite sides of the board to reduce potential offending crosstalk.

9. A communication jack connector, comprising:

a jack housing having a plug opening, the plug opening having an axis and the housing being constructed and arranged for receiving a mating plug connector in the plug opening along the direction of the plug axis; and a communication connector assembly supported within the jack housing, for electrically contacting said mating plug connector when the plug connector is received in the jack housing, said connector assembly comprising:

a wire board having a front edge region, a number of compensation coupling contacts disposed at the front edge region, and one or more compensation elements associated with the coupling contacts, said elements being selected to produce a desired crosstalk compensation coupling;

a number of elongated terminal contact wires extending above the wire board for making electrical connections with corresponding terminals of the plug connector along a line of contact, wherein the terminal contact wires include:

connecting portions for making electrical contact with the corresponding terminals of the plug connector, the connecting portions having free ends;

base portions opposite the free ends of the connecting portions, wherein the base portions are arranged to support the contact wires on the board and to connect the contact wires to conductive paths on or within the board; and the free ends of the contact wires are located ahead of said line of contact, and are formed to be deflected toward the wire board and to connect with corresponding ones of the compensation coupling contacts when the connector assembly is engaged by the plug connector, so that said crosstalk compensation coupling is operative at said line of contact.

10. A connector assembly according to claim 9, wherein the compensation coupling contacts are in the form of conductive pads.

11. A jack connector according to claim 9, wherein the compensation coupling contacts are in the form of stiff wires mounted on the wire board.

12. A jack connector according to claim 9, wherein the compensation coupling contacts are in the form of metal plates having bases mounted on the wire board.

13. A jack connector according to claim 12, wherein the bases of adjacent ones of the metal plates enter the wire board from opposite sides of the board to reduce potential offending crosstalk.

14. A jack connector according to claim 9, wherein the compensation elements associated with the coupling contacts are disposed in a region of the wire board in the vicinity of the coupling contacts.

15. A communication jack connector according to claim 9, including a terminal housing formed to cover a rear portion of the wire board, and one or more fastening members constructed and arranged to join the terminal housing to the jack housing.

16. A communication jack connector according to claim 15, wherein the fastening members are in the form of catches that project from sides of the terminal housing, and free ends of the catches are configured to engage corresponding sides of the jack housing.

17. A communication jack connector according to claim 16, wherein the catches have hooked ends arranged to engage recesses formed in the sides of the jack housing.

18. A connector assembly according to claim 9, wherein the compensation coupling contacts are arrayed in a row along the front edge region of the wire board.

19. A jack connector according to claim 18, wherein the compensation coupling contacts are spaced apart from one another by a distance corresponding to a spacing between the free ends of the terminal contact wires.

* * * * *

UNITED STATES PATENT AND TRADEMARK OFFICE

CERTIFICATE OF CORRECTION

PATENT NO. : 6,350,158 B1
DATED : February 26, 2002
INVENTOR(S) : Arnett et al.

It is certified that error appears in the above-identified patent and that said Letters Patent is hereby corrected as shown below:

Title page,
Showing an illustrative figure, should be deleted and substituted therefor the attached title page.

Drawings,
Delete drawing sheets 1-6, and substitute therefor the drawing sheets, consisting of FIG.1-9, as shown on the attached pages.

Signed and Sealed this

Second Day of July, 2002

*Attest:*

*Attesting Officer*

JAMES E. ROGAN
*Director of the United States Patent and Trademark Office*

(12) United States Patent
Arnett et al.

(10) Patent No.: US 6,350,158 B1
(45) Date of Patent: Feb. 26, 2002

(54) LOW CROSSTALK COMMUNICATION CONNECTOR

(75) Inventors: Jaime Ray Arnett, Fishers; Robert Ray Goodrich, Indianapolis, both of IN (US); Amid Ihsan Hashim, Randolph, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/664,814

(22) Filed: Sep. 19, 2000

(51) Int. Cl.[7] ..... H01R 24/00
(52) U.S. Cl. ..... 439/676; 439/941; 439/344
(58) Field of Search ..... 439/676, 557, 439/344, 941

(56) References Cited

U.S. PATENT DOCUMENTS

| | | | | |
|---|---|---|---|---|
| 5,186,647 A | | 2/1993 | Denkmann | |
| 5,299,956 A | | 4/1994 | Brownell | |
| 5,580,270 A | | 12/1996 | Pantland | |
| 5,885,111 A | * | 3/1999 | Yu | 439/676 |
| 5,997,358 A | | 12/1999 | Adriaenssens | |
| 6,116,964 A | | 9/2000 | Goodrich | |
| 6,139,371 A | | 10/2000 | Troutman | |
| 6,155,881 A | | 12/2000 | Arnett | |
| 6,165,023 A | | 12/2000 | Troutman | |
| 6,176,742 B1 | | 1/2001 | Arnett | |
| 6,186,834 B1 | * | 2/2001 | Arnett et al. | 439/676 |
| 6,196,880 B1 | * | 3/2001 | Goodrich et al. | 439/676 |

* cited by examiner

*Primary Examiner*—Gary Paumen
*Assistant Examiner*—Ross Gushi
(74) *Attorney, Agent, or Firm*—Law Office of Leo Zucker

(57) ABSTRACT

A communication connector assembly that incorporates crosstalk compensation. A number of compensation coupling contacts, e.g., conductive pads, stiff wires or plates, are mounted on a front edge region of a wire board that supports a number of terminal contact wires. Compensation elements associated with the wire board are connected to the contacts and are selected to produce, e.g., capacitive crosstalk compensation coupling. The terminal contact wires have connecting portions for contacting corresponding terminals of a mating connector along a line of contact. Free ends of the contact wires, ahead of the line of contact, are formed to deflect toward the wire board and to connect with the compensation coupling contacts on the board when engaged by the mating connector. The compensation coupling is therefore effective at the line of contact with the mating connector. In the disclosed embodiments, the assembly is incorporated in a modular jack connector.

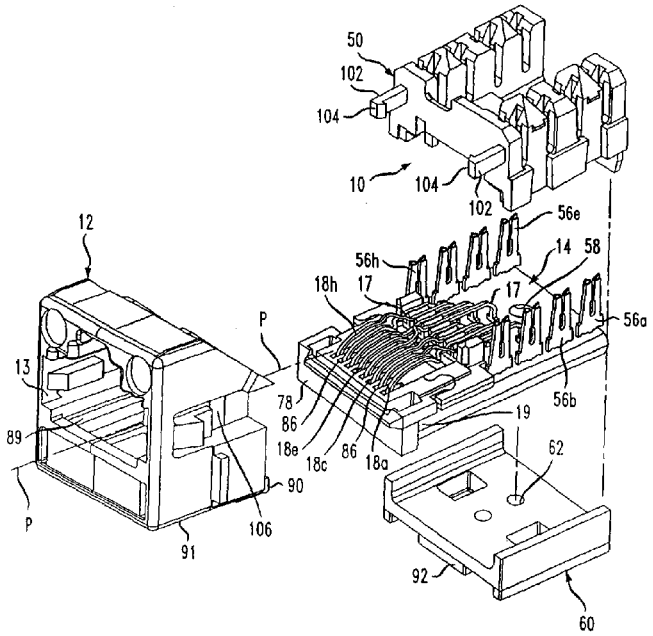

19 Claims, 6 Drawing Sheets